US009644308B2

(12) United States Patent
Leibman et al.

(10) Patent No.: US 9,644,308 B2
(45) Date of Patent: May 9, 2017

(54) NOZZLE FORMED IN A DISPENSING APPARATUS

(71) Applicant: General Electric Company, Schenectady, NY (US)

(72) Inventors: Alexander Boris Leibman, Prospect, KY (US); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 346 days.

(21) Appl. No.: 14/457,313

(22) Filed: Aug. 12, 2014

(65) Prior Publication Data

US 2016/0047077 A1 Feb. 18, 2016

(51) Int. Cl.
*D06F 39/02* (2006.01)
*D06F 23/04* (2006.01)

(52) U.S. Cl.
CPC ..... *D06F 39/028* (2013.01); *D06F 23/04* (2013.01); *D06F 39/022* (2013.01)

(58) Field of Classification Search
CPC ..... D06F 39/028; D06F 23/04; D06F 39/022
See application file for complete search history.

(56) References Cited

U.S. PATENT DOCUMENTS 5,253,494 A * 10/1993 Frucco ..... D06F 39/028 68/12.18
6,227,012 B1 5/2001 Borroni et al.
7,313,934 B2 1/2008 Heo et al.
2005/0229645 A1* 10/2005 Kim ..... D06F 39/028 68/17 R
2007/0056329 A1* 3/2007 Song ..... D06F 39/02 68/17 R
2007/0056330 A1* 3/2007 Song ..... D06F 39/02 68/17 R
2007/0163307 A1* 7/2007 Kramme ..... D06F 39/02 68/17 R
2008/0155756 A1* 7/2008 Ogden ..... D06F 35/006 8/137
2010/0281927 A1 11/2010 Lee et al.
2011/0056029 A1 3/2011 Bae et al.
2011/0277515 A1* 11/2011 Doh ..... D06F 39/02 68/17 R
2012/0017653 A1* 1/2012 Doh ..... D06F 39/022 68/17 R
2012/0036901 A1* 2/2012 Mackay ..... D06F 29/00 68/17 R
2012/0060568 A1* 3/2012 Buso ..... D06F 39/02 68/17 R (Continued)

FOREIGN PATENT DOCUMENTS

KR 100208090 B1 7/1999
WO WO 2007/124799 11/2007

(Continued)

*Primary Examiner* — Michael Barr
*Assistant Examiner* — Benjamin L Osterhout
(74) *Attorney, Agent, or Firm* — Dority & Manning, P.A.

(57) ABSTRACT

A washing machine appliance and a fluid additive dispenser are provided. The fluid additive dispenser includes one or more features for containing and dispensing fluid additives. The fluid additive dispenser also includes a spray nozzle formed or molded in a shower plate of the dispenser.

20 Claims, 10 Drawing Sheets

(56) References Cited

U.S. PATENT DOCUMENTS

| | | | | |
|---|---|---|---|---|
| 2012/0073061 | A1* | 3/2012 | Hendrickson | D06F 39/02 8/137 |
| 2012/0096901 | A1* | 4/2012 | Zattin | D06F 39/02 68/13 R |
| 2012/0266389 | A1* | 10/2012 | Ihne | D06F 39/028 8/137 |
| 2013/0180293 | A1* | 7/2013 | Huerth | D06F 39/02 68/17 R |
| 2014/0190220 | A1* | 7/2014 | Lee | D06F 39/02 68/17 R |

FOREIGN PATENT DOCUMENTS

| | | |
|---|---|---|
| WO | WO 2013/098005 | 7/2013 |
| WO | WO 2013/169005 | 11/2013 |

* cited by examiner

NOZZLE FORMED IN A DISPENSING APPARATUS

FIELD OF THE INVENTION

The subject matter of the present disclosure relates generally to fluid additive dispensers for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various fluid additives, e.g., detergent, fabric softener, and/or bleach. The fluid additives can be mixed with water within a wash tub of the appliance to form the wash fluid. Various fluid additives may also be added to water to form the rinse fluid.

To introduce one or more fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a fluid additive dispenser may be mounted to or directly beneath top panel of a vertical axis washing machine appliance that can receive a fluid additive and direct the fluid additive into a wash tub of the appliance. Similarly, a horizontal axis washing machine appliance can include a dispenser that receives a fluid additive and directs the fluid additive into a wash tub of the appliance. Such dispensers may contain one or more compartments for the receipt of one or more fluid additives. The dispenser also may include a shower plate for controlling the flow of water from one or more valves to the one or more compartments to flush the fluid additive contained therein.

During various cycles of the washing machine appliance, a volume of water also may be added to wash tub through a spray nozzle. Typically, the spray nozzle is a separate part including a water channel and nozzle that are welded together and connected to a valve of the washing machine appliance by a hose and clamps. Thus, for a typical washing machine appliance, the spray nozzle has several parts requiring multiple assembly operations and having several potential leak points, such as, e.g., the point at which the nozzle and water channel are joined, the point at which the water channel and hose are joined, and the point at which the hose and the valve are joined. Therefore, a spray nozzle requiring fewer parts could reduce the manufacturing time and expense of a washing machine appliance, as well as water leakage within the appliance.

Accordingly, a washing machine appliance having a fluid additive dispenser would be useful. More particularly, a washing machine appliance having a spray nozzle formed or molded in the shower plate of the fluid additive dispenser would be useful.

BRIEF DESCRIPTION OF THE INVENTION

The present subject matter provides a washing machine appliance and a fluid additive dispenser. The fluid additive dispenser includes one or more features for containing and dispensing fluid additives. The fluid additive dispenser also includes a spray nozzle formed or molded in a shower plate of the dispenser. Additional aspects and advantages of the invention will be set forth in part in the following description, or may be apparent from the description, or may be learned through practice of the invention.

In a first exemplary embodiment, a washing machine appliance defining a vertical direction includes a cabinet; a wash tub located within the cabinet; a wash basket rotatably mounted within the wash tub; and a fluid additive dispenser. The fluid additive dispenser defines a sliding direction and a width direction. The fluid additive dispenser includes a housing having an upper surface, a lower surface, opposing side surfaces, a back surface, and a front portion. The housing is configured to receive a flow of water. The fluid additive dispenser also includes a dispenser drawer slidably received in the housing; the dispenser drawer has a plurality of compartments for the receipt of one or more fluid additives. The fluid additive dispenser further includes a plate disposed in the housing below the upper surface and defining a channel for a flow of water. The plate also defines a nozzle that directs the flow of water into the wash basket.

In a second exemplary embodiment, a washing machine appliance defining a vertical direction includes a cabinet; a wash tub located within the cabinet; a wash basket rotatably mounted within the wash tub; and a fluid additive dispenser. The fluid additive dispenser defines a sliding direction and a width direction. The fluid additive dispenser includes a housing having an upper surface, a lower surface, opposing side surfaces, a back surface, and a front portion. The housing is configured to receive a flow of water. The fluid additive dispenser also includes a dispenser drawer slidably received in the housing; the dispenser drawer has a plurality of compartments for the receipt of one or more fluid additives. The fluid additive dispenser further includes a plate disposed in the housing below the upper surface and defining a channel for a flow of water. The channel defines a nozzle that directs the flow of water from the channel into the wash basket.

In a third exemplary embodiment, a fluid additive dispenser for an appliance includes a housing having an upper surface, a lower surface, opposing side surfaces, a back surface, and a front portion. The housing is configured to receive a flow of fluid. The fluid additive dispenser also includes a dispenser drawer slidably received in the housing; the dispenser drawer has a plurality of compartments for the receipt of one or more fluid additives. The fluid additive dispenser further includes a plate disposed in the housing below the upper surface and having a top surface and a bottom surface. The bottom surface of the plate defines a channel for a flow of fluid, and the channel defines a nozzle. The nozzle directs the flow of fluid from the channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same reference numerals in different figures denotes the same or similar features.

DETAILED DESCRIPTION

Figure 1:
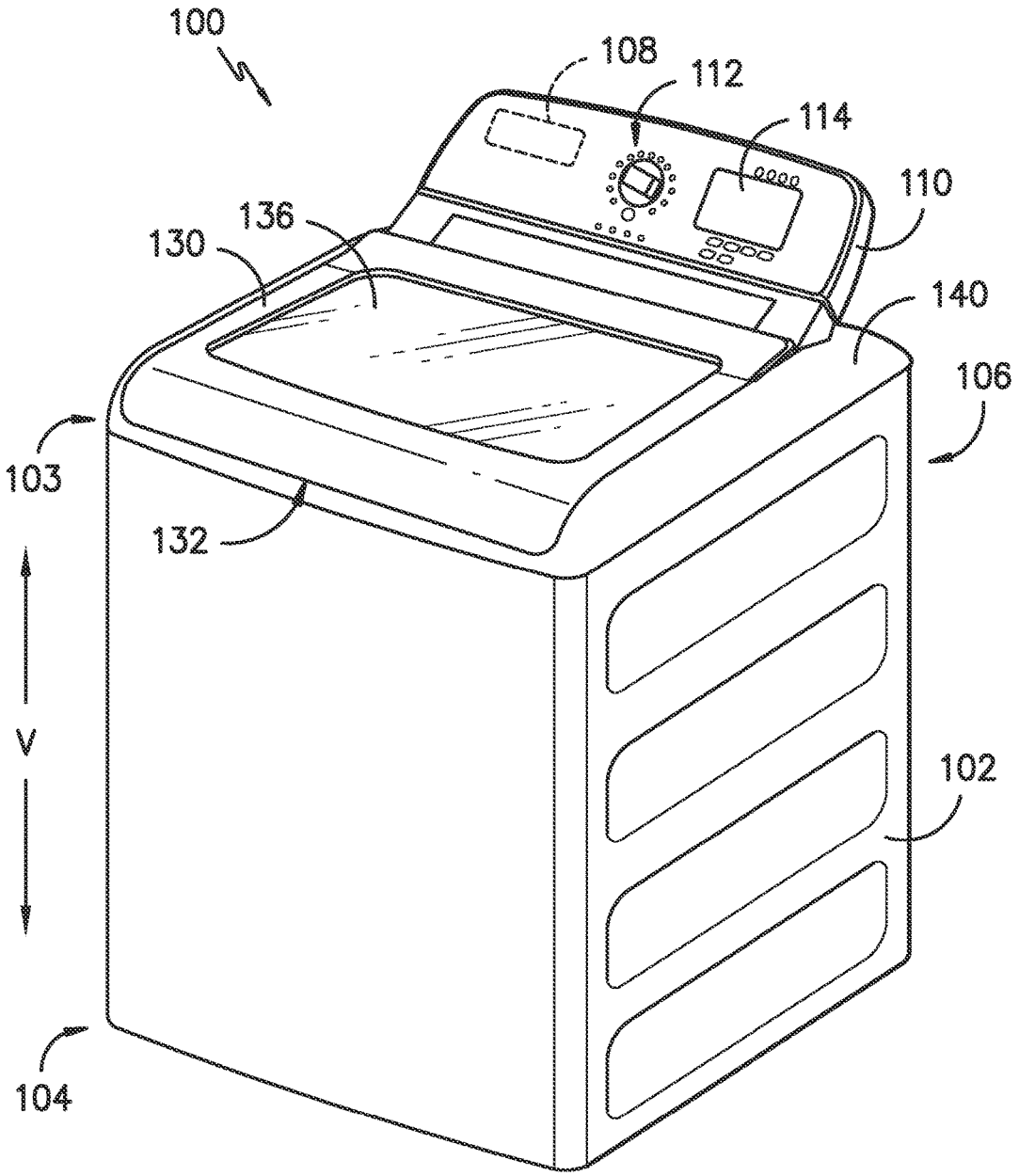
FIG. 1 illustrates an exemplary embodiment of a washing machine appliance of the present invention with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
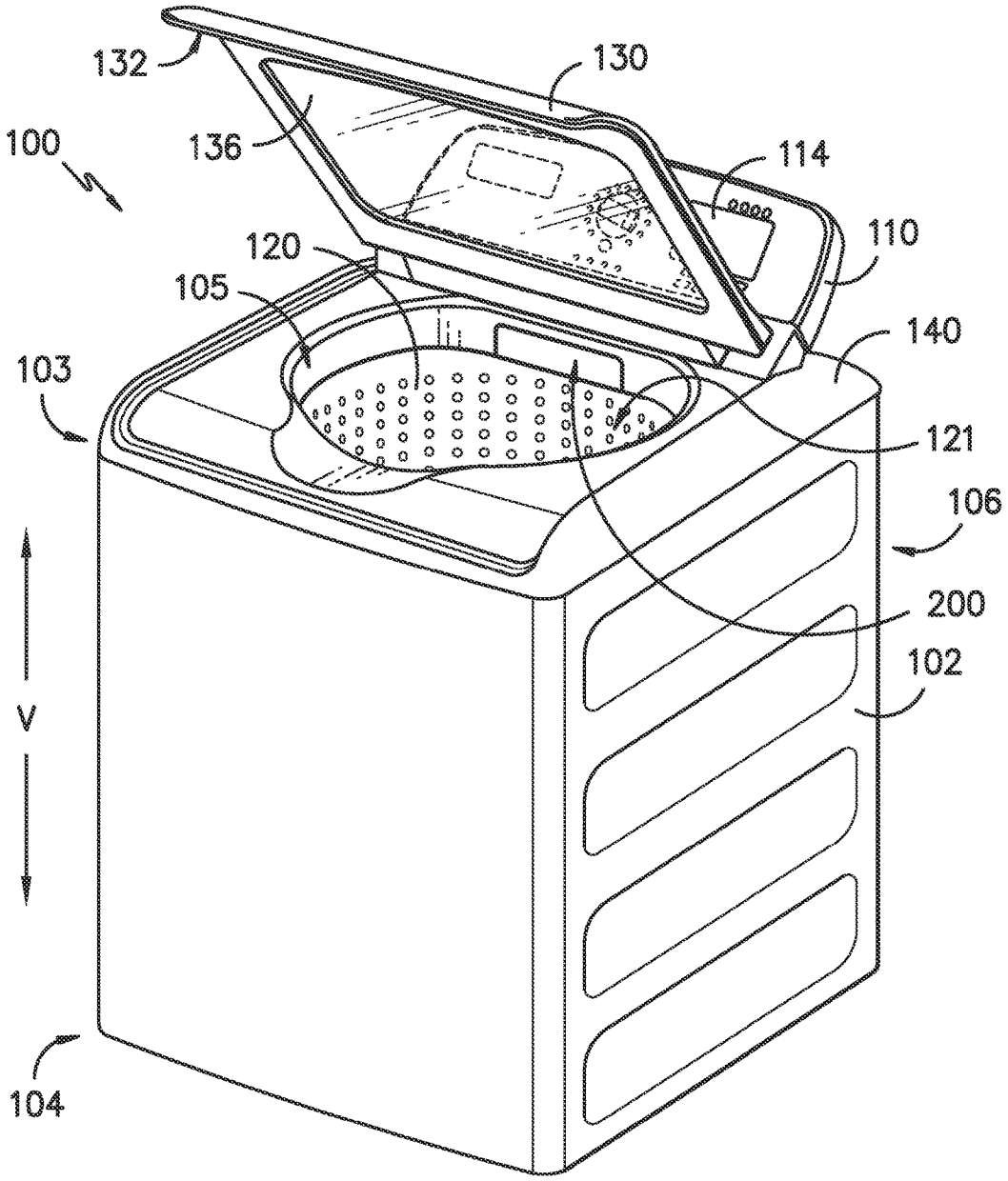
FIG. 2 illustrates the exemplary embodiment of a washing machine shown in FIG. 1 except with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

Top panel 140 includes at least one fluid additive dispenser 200 (FIG. 2) for receipt of one or more fluid additives, e.g., detergent, fabric softener, and/or bleach. While only one fluid dispenser will be described herein, it will be understood that multiple fluid dispensers may be used in alternative embodiments of the invention. Fluid additive dispenser 200 is positioned near wash tub 121; in FIG. 2, dispenser 200 is depicted at a vertical position above wash tub 121 near back panel 106 of cabinet 102, but dispenser 200 could be positioned in other locations as well. Fluid additive dispenser 200 is described in greater detail below.

In an illustrative embodiment, laundry items are loaded into wash basket 120 through opening 105, and washing operation is initiated through operator manipulation of input selectors 112. Wash basket 120 is filled with water and detergent and/or other fluid additives from e.g., dispenser 200, to form wash and rinse fluids. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may be utilized with the present subject matter as well.

Figure 3:
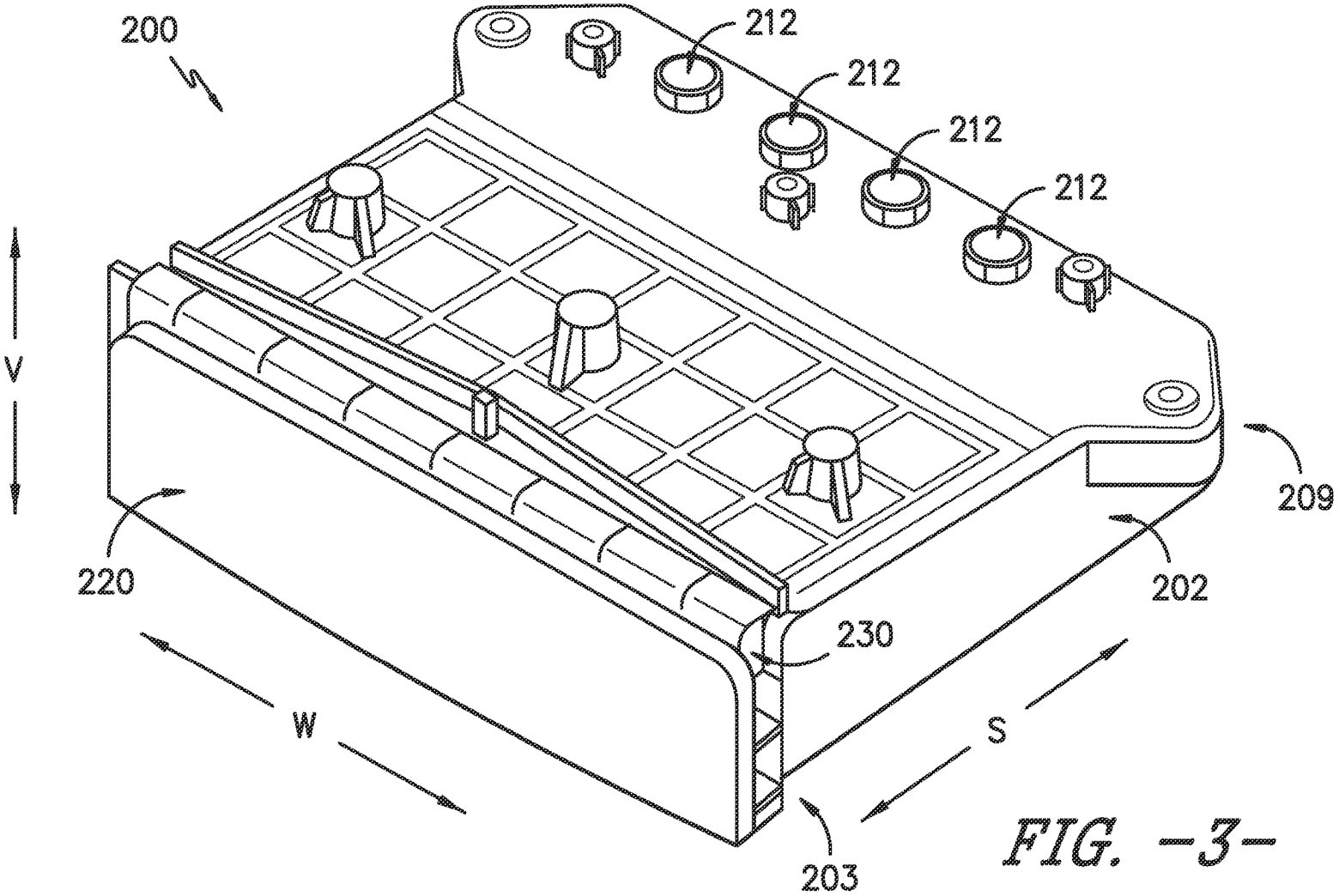
FIG. 3 is a front, perspective view of an exemplary embodiment of a fluid dispenser of the present invention.

FIG. 3 illustrates an exemplary embodiment of fluid additive dispenser 200. As shown, dispenser 200 includes housing 202 and dispenser drawer 220. Dispenser drawer 220 slides into and out of housing 202 along a sliding direction S. Housing 202 has a front portion 203 and a back portion 209 that are spaced apart along the sliding direction S.

Figure 4:
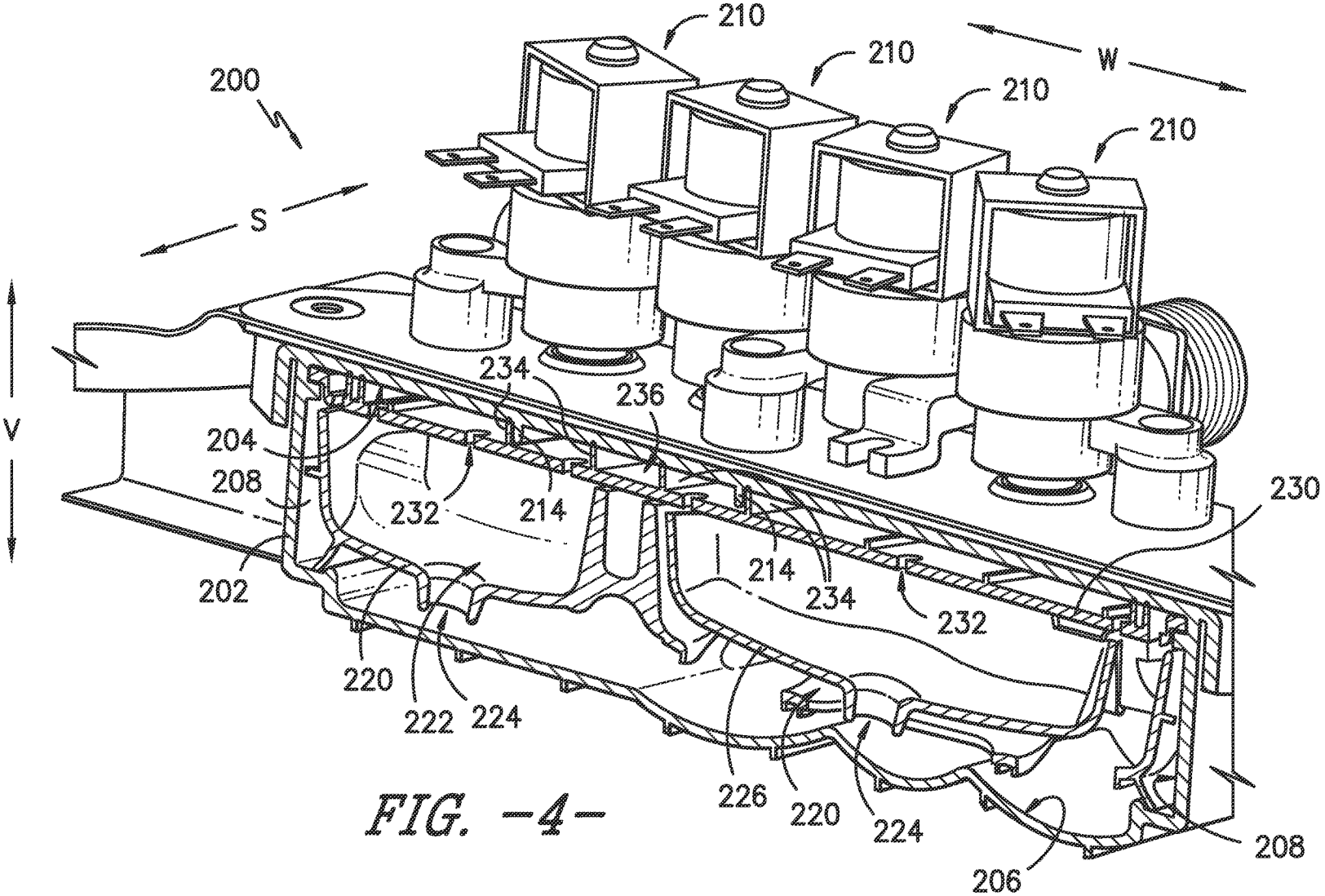
FIG. 4 is a cross-sectional view of the exemplary embodiment of a fluid dispenser shown in FIG. 3.

FIG. 4 is a cross-sectional view of the exemplary embodiment of a fluid additive dispenser 200 shown in FIG. 3. As illustrated, housing 202 has an upper surface 204, lower surface 206, and opposing side surfaces 208. Dispenser drawer 220 includes compartments 222 for the receipt of fluid additives such as fabric softener, detergent, bleach, and the like. Compartments 222 may be configured to receive a removable dispenser cup 226. In alternative embodiments, dispenser drawer 220 may be configured with one, two, or three or more compartments.

As illustrated in FIGS. 3 and 4, housing 202 is configured to receive a flow of hot and/or cold water from valves 210 through inlets 212. Valves 210 control the flow of water into fluid additive dispenser 200 to convey water or a mixture of water and fluid additive to wash basket 120. Whether hot or cold water is supplied to fluid additive dispenser 200 may depend on the wash cycle selected by a user of washing machine appliance 100. Alternatively, one or more compartments of dispenser drawer 220 may be designated to receive a particular fluid additive, and whether hot or cold water is supplied to a given compartment may depend on the compartment's designated fluid additive.

Additionally, each compartment 222 defines an outlet 224 for the flow of a mixture of water and fluid additive from the compartment to wash basket 120. The mixture of water and fluid additive may be conveyed to wash basket 120 through, e.g., pipes, tubes, or the like. Alternatively, housing 202, dispenser drawer 220, and outlets 224 may be configured such that water or a mixture of water and a fluid additive flows from dispenser drawer 220 through outlets 224, along lower surface 206 of housing 202, and into wash basket 120. As described above, the mixture of water and fluid additive flows to wash basket 120 to form a wash and/or rinse fluid for cleaning laundry articles contained in wash basket 120. Further, water may be provided to wash basket 120 through fluid additive dispenser 200 to form a wash and/or rinse fluid.

Figure 5:
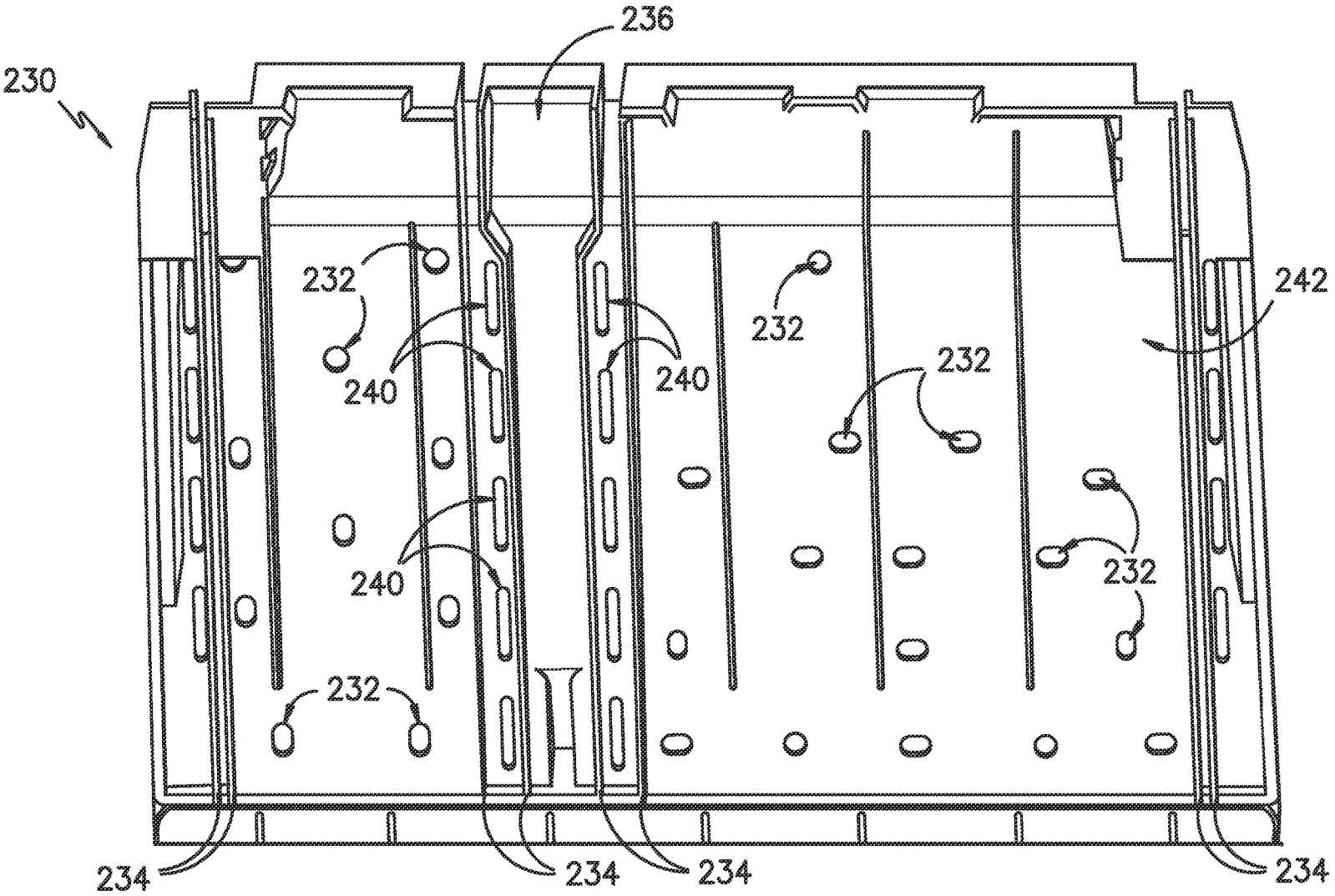
FIG. 5 is a top view of an exemplary embodiment of a shower plate of the present subject matter.

As shown in FIG. 4, a shower plate 230 is disposed in housing 202 below upper surface 204. Plate 230 is secured in housing 202 via an interference fit between the two components such that plate 230 is secured in housing 202 without the use of mechanical fasteners, glue, welding, or the like. Referring to FIG. 5, plate 230 defines a plurality of apertures 232 for the flow-through of water introduced into housing 202 from valves 210 to compartments 222. The plurality of apertures control the flow of water into each compartment 222, creating a shower-like flow into each compartment rather than allowing a deluge of water in one area of the compartment, which could hinder the complete flushing of the fluid additive from the compartment. The flow of water into a compartment through apertures 232 flushes the fluid additive contained in the compartment 222 from the compartment through its outlet 224, providing the mixture of water and the fluid additive to wash basket 120.

As illustrated in FIGS. 4 and 5, plate 230 also defines a plurality of plate projections 234. Plate projections 234 extend upwardly along the vertical direction V and longitudinally along the sliding direction S and are spaced apart along the width direction W. Similarly, the upper surface 204 of housing 202 may define a plurality of upper surface projections 214 extending downwardly along the vertical direction V and longitudinally along the sliding direction S that are spaced apart along the width direction W. An upper surface projection 214 may be located between each plate adjacent pair of plate projections 234 to form a seal between portions of plate 230. The seal prevents water introduced into housing 202 from prematurely entering a compartment 222 of dispenser drawer 220 and prevents fluid from one compartment 222 from entering another compartment 222.

Moreover, as shown in FIGS. 4 and 5, plate 230 may also define a plurality of relief slots 240 between adjacent plate projections 234. Relief slots 240 allow any water that penetrates the barrier formed by a plate projection 234 and an upper surface projection 214 to flow into the designated compartment of dispenser drawer 220 rather than into another compartment of the dispenser drawer. In other embodiments, relief slots 240 may allow water to escape to an area between compartments of dispenser drawer 220 and be drained from dispenser drawer 220 by any suitable means, such as an outlet defined in lower surface 206 of housing 202.

Figure 6:
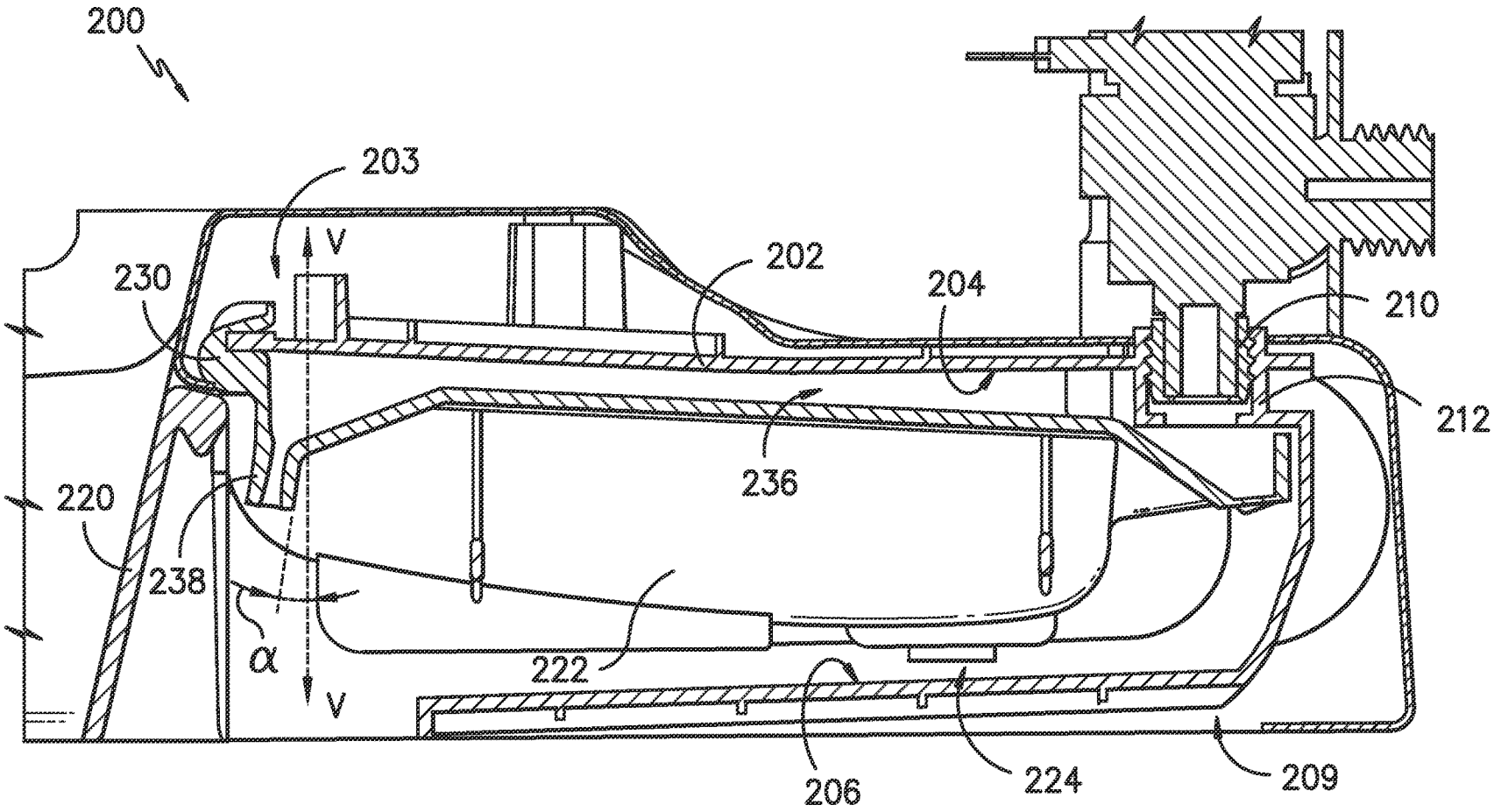
FIG. 6 is a cross-sectional view of an exemplary embodiment of a fluid additive dispenser incorporating the shower plate of FIG. 5.

Referring now to FIGS. 5 and 6, plate 230 defines a channel 236 for the flow of water to a nozzle 238. As shown in the exemplary embodiment of FIG. 5, channel 236 is defined by two plate projections 234, which contain the flow of water within channel 236 such that the water exits through nozzle 238. Nozzle 238 is defined in plate 230 near the front portion 203 of housing 202 to direct a flow of water to wash basket 120. Nozzle 238 projects downwardly along the vertical direction V from plate 230, and the flow path for the flow of water through nozzle 238 may be at an angle $\alpha$ with respect to the vertical direction V. Angle $\alpha$ may be in the range of about 5° to about 30°. In alternative embodiments, nozzle 238 may project straight down from plate 230 such that nozzle 238 is not at an angle with respect to the vertical direction V.

Other configurations of channel 236 and nozzle 238 may be used as well. As an example, channel 236 may be defined at other locations on plate 230. As a further example, plate projections 234 defining channel may be configured differently than as shown in the exemplary embodiment, and in other embodiments, channel 236 may be defined by other elements of plate 230. Additionally, nozzle 238 may have other shapes and may be positioned differently with respect to channel 236 and/or housing 202.

A given valve 210 may control the flow of hot or cold water into channel 236 or across the remainder of plate 230. For example, in the exemplary embodiment illustrated in FIG. 6, a valve 210 provides a flow of water through inlet 212 to channel 236. Similarly, another valve 210 may provide a flow of water to plate 230 on one side of channel 236 and another valve 210 may provide a flow of water to plate 230 on the other side of channel 236. As described above, the water provided to plate 230 flows through apertures 232 to flush a fluid additive from compartments 222 or to otherwise provide fluid to wash basket 120. In certain embodiments, one valve 210 could be dedicated to provide water to channel 236 and one valve 210 could be dedicated to supply water to each compartment 222 of dispenser drawer 220 to flush a fluid additive from each compartment. In other embodiments, one valve 210 could provide water to channel 236 and compartments 222. Other configurations of valves 210 could be used as well, and alternatively, water could be provided to fluid additive dispenser 200 through appropriate means other than valves 210.

Figure 7:
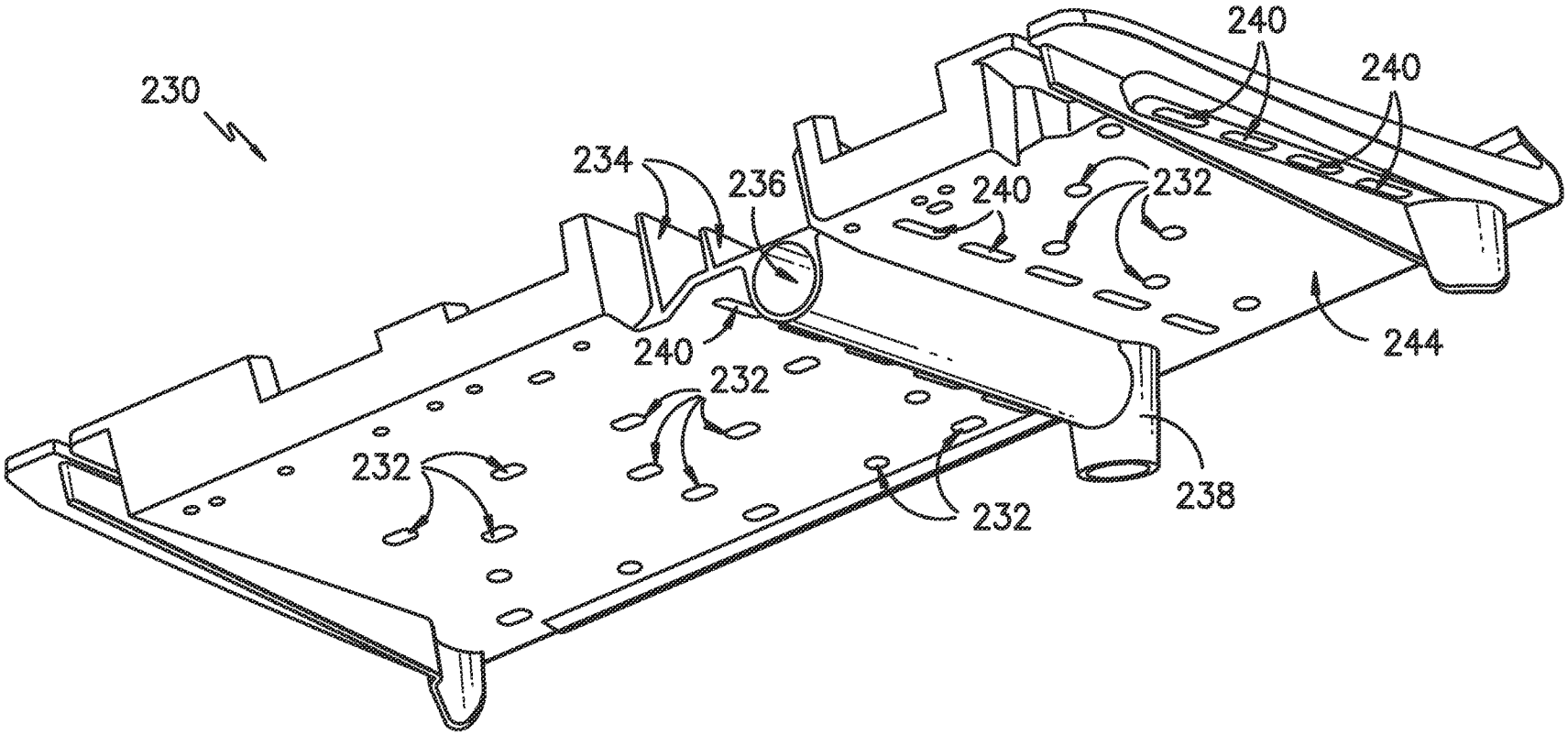
FIG. 7 is a bottom perspective view of another exemplary embodiment of a shower plate of the present subject matter.
Figure 8:
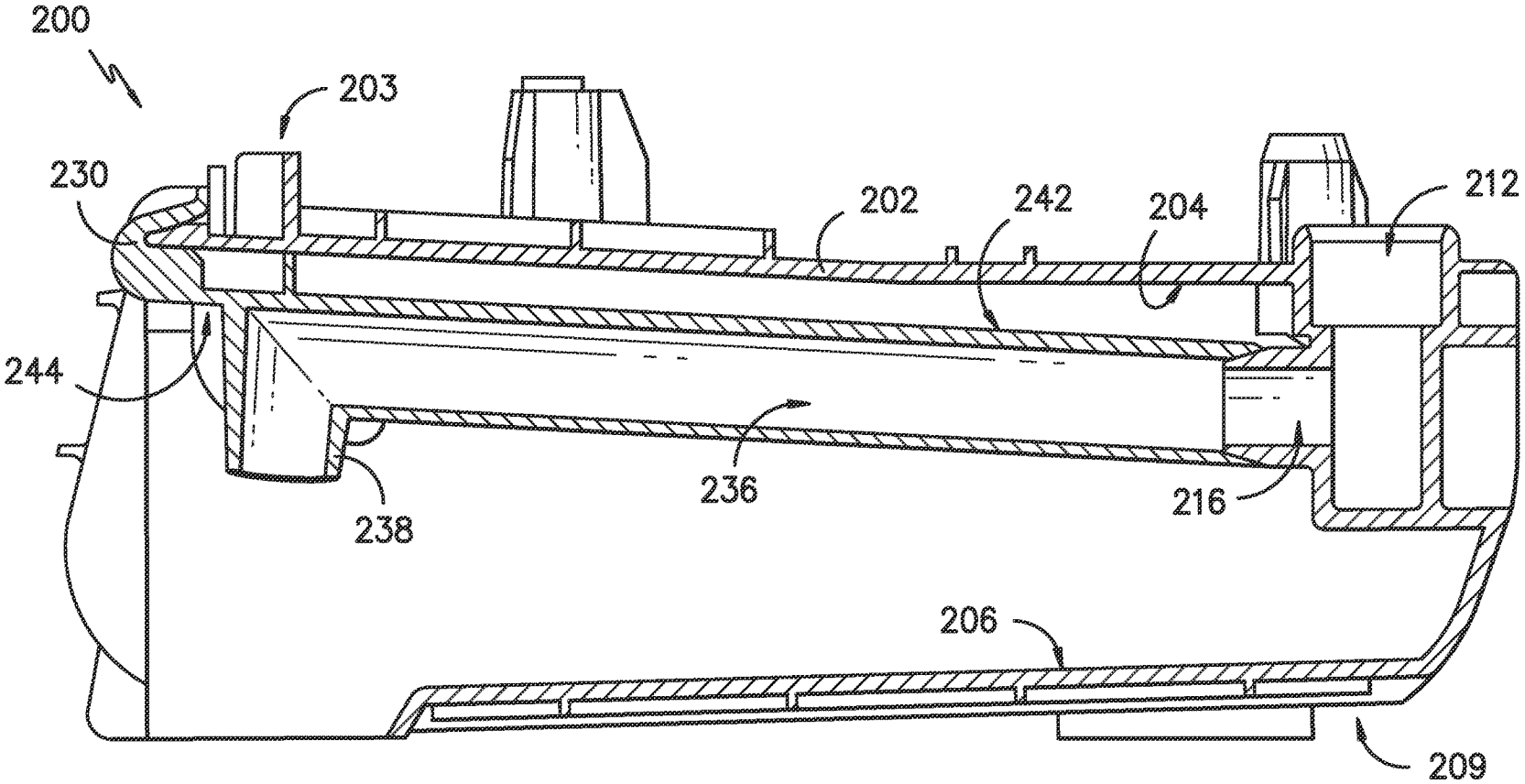
FIG. 8 is a cross-sectional view of an exemplary embodiment of a fluid additive dispenser incorporating the shower plate of FIG. 7.

FIGS. 7 and 8, which use the same reference numerals to denote the same or similar features, illustrate another exemplary embodiment of a shower plate disposed in housing 202 below upper surface 204. As shown in FIG. 8, plate 230 is secured in housing 202 via an interference fit between the two components such that plate 230 is secured in housing 202 without the use of mechanical fasteners, glue, welding, or the like. Referring to FIG. 7, plate 230 defines a plurality of apertures 232 for a shower-like flow of water from valves 210 to each compartment 222 to flush the fluid additive from the compartment through its outlet 224, providing the mixture of water and the fluid additive to wash basket 120.

Plate 230 also defines a plurality of plate projections 234 extending upwardly along the vertical direction V and longitudinally along the sliding direction S that are spaced apart along the width direction W. Similarly, the upper surface 204 of housing 202 may define a plurality of upper surface projections 214 (FIG. 4) extending downwardly along the vertical direction V and longitudinally along the sliding direction S that are spaced apart along the width direction W. An upper surface projection 214 may be located between each plate adjacent pair of plate projections 234 to form a seal between portions of plate 230. The seal prevents water introduced into housing 202 from prematurely entering a compartment 222 of dispenser drawer 220 and prevents fluid from one compartment 222 from entering another compartment 222.

Additionally, as shown in FIG. 7, plate 230 defines a plurality of relief slots 240 between adjacent plate projections 234. Relief slots 240 allow any water that penetrates the barrier formed by a plate projection 234 and an upper surface projection 214 to flow into the designated compartment of dispenser drawer 220 rather than into another compartment of the dispenser drawer. In other embodiments, relief slots 240 may allow water to escape to an area between compartments of dispenser drawer 220 and be drained from dispenser drawer 220 by any suitable means, such as an outlet defined in lower surface 206 of housing 202.

Further, plate 230 defines a tubular channel 236 for the flow of water to a nozzle 238. As shown in the exemplary embodiment of FIGS. 7 and 8, plate 230 has a top surface 242 and a bottom surface 244, and channel 236 is defined on bottom surface 244 of plate 230. In alternative embodiments, channel 236 may be defined on top surface 242 or may be otherwise defined by plate 230.

Nozzle 238 is defined in plate 230 near the front portion 203 of housing 202 to direct a flow of water to wash basket 120. Nozzle 238 projects downwardly substantially along the vertical direction V from plate 230 such that nozzle 238 directs the flow of water approximately straight down from channel 236. In alternative embodiments, the flow path for the flow of water through nozzle 238 may be at an angle $\alpha$ with respect to the vertical direction V. Angle $\alpha$ may be in the range of about 5° to about 30°. Further, although nozzle 238 is shown in the exemplary embodiment as being generally cylindrical in shape, in other embodiments nozzle 238 may have other shapes. The shape of nozzle 238 may be selected based on the desired trajectory for the flow of water into wash basket 120.

A given valve may control the flow of hot or cold water into channel 236 or across the remainder of plate 230. For example, in the exemplary embodiment illustrated in FIG. 8, an outlet 216 is defined at a back portion 209 of housing 202, and channel 236 is coupled to outlet 216 through the interference fit between plate 230 and housing 202. A valve 210 may provide a flow of water to housing 202 that flows from housing 202 through outlet 216 to channel 236.

Similarly, another valve 210 may provide a flow of water across the top surface of plate 230 that, as described above, flows through apertures 232 to flush a fluid additive from compartments 222. In certain embodiments, one valve 210 could be dedicated to provide water to channel 236 and one valve 210 could be dedicated to supply water to each compartment 222 of dispenser drawer 220 to flush a fluid additive from each compartment. In other embodiments, only one valve 210 may be provided to supply water to channel 236 and compartments 222. Other configurations of valves 210 could be used as well, and alternatively, water could be provided to fluid additive dispenser 200 without using valves 210.

Other configurations of channel 236 and nozzle 238 may be used as well. As an example, channel 236 may be defined at other locations on plate 230. As a further example, channel 236 may be shaped other than as a tube. Additionally, nozzle 238 may have other shapes and may be positioned differently with respect to channel 236 and/or housing 202.

Figure 9:
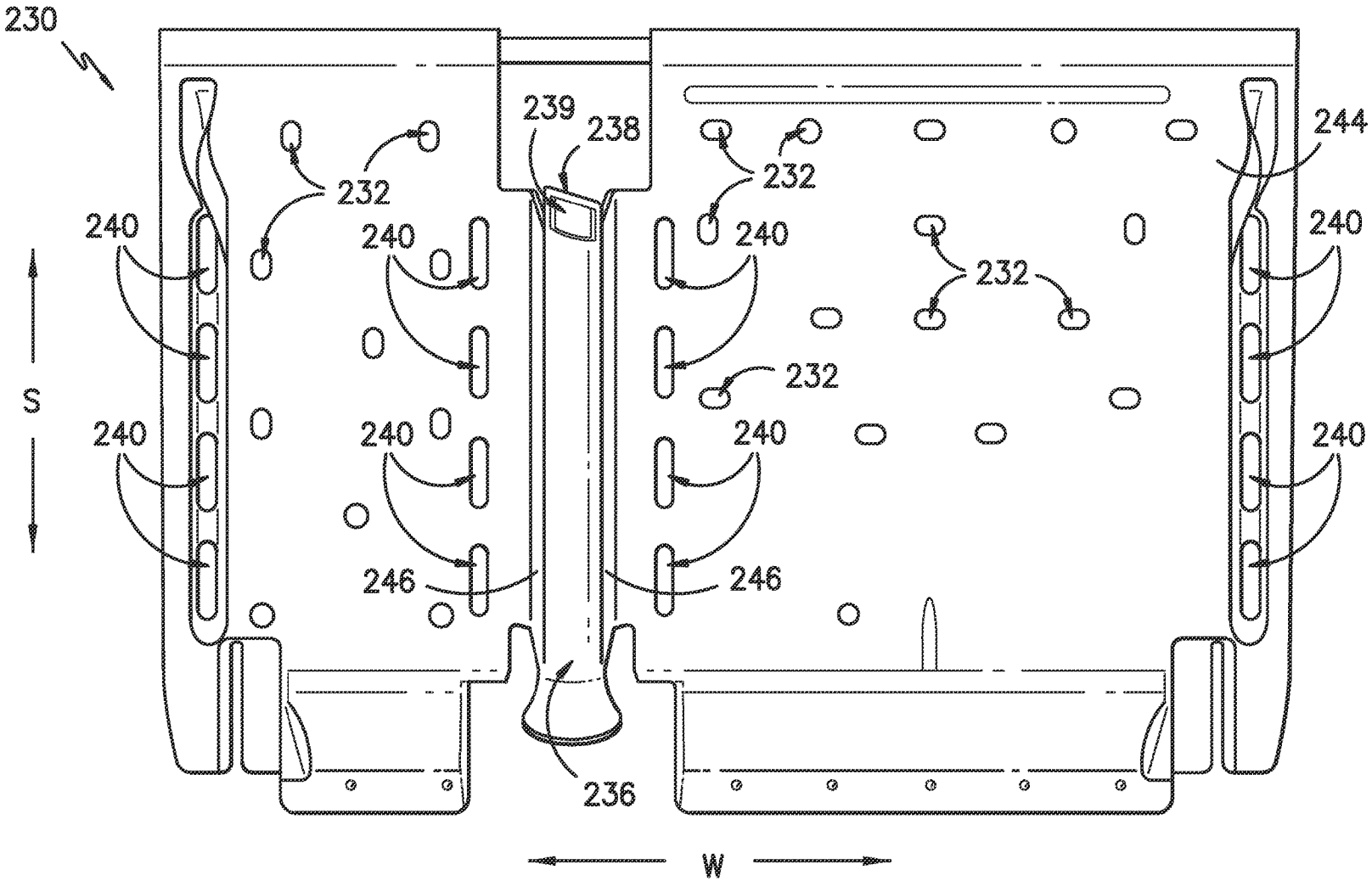
FIG. 9 is a bottom view of another exemplary embodiment of a shower plate of the present subject matter.
Figure 10:
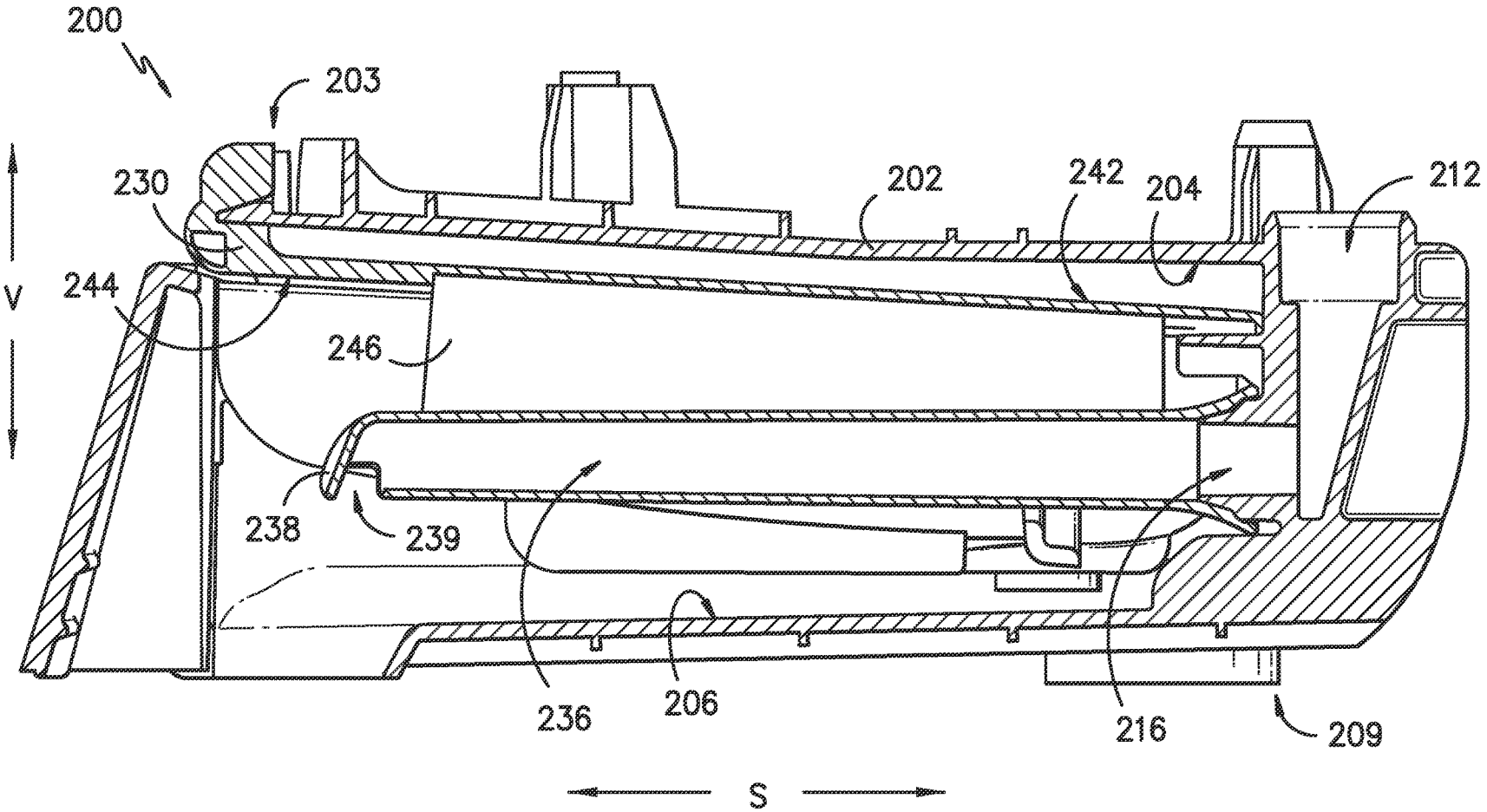
FIG. 10 is a cross-sectional view of an exemplary embodiment of a fluid additive dispenser incorporating the shower plate of FIG. 9.

FIGS. 9 and 10, which use the same reference numerals to denote the same or similar features, illustrate another exemplary embodiment of a shower plate disposed in housing 202 below upper surface 204. As shown in FIG. 10, plate 230 is secured in housing 202 via an interference fit between the two components such that plate 230 is secured in housing 202 without the use of mechanical fasteners, glue, welding, or the like. Referring to FIG. 9, plate 230 defines a plurality of apertures 232 for a shower-like flow of water from valves 210 to each compartment 222 to flush the fluid additive from the compartment through its outlet 224, providing the mixture of water and the fluid additive to wash basket 120.

Plate 230 may also define a plurality of plate projections (not shown) extending upwardly along the vertical direction V and longitudinally along the sliding direction S that are spaced apart along the width direction W. Similarly, the upper surface 204 of housing 202 may define a plurality of upper surface projections 214 (FIG. 4) extending downwardly along the vertical direction V and longitudinally along the sliding direction S that are spaced apart along the width direction W. An upper surface projection 214 may be located between each plate adjacent pair of plate projections to form a seal between portions of plate 230. The seal prevents water introduced into housing 202 from prematurely entering a compartment 222 of dispenser drawer 220 and prevents fluid from one compartment 222 from entering another compartment 222.

Additionally, as shown in FIG. 9, plate 230 defines a plurality of relief slots 240. Relief slots 240 allow any water that penetrates the barrier formed by a plate projection and an upper surface projection 214 to flow into the designated compartment of dispenser drawer 220 rather than into another compartment of the dispenser drawer. In other embodiments, relief slots 240 may allow water to escape to an area between compartments of dispenser drawer 220 and be drained from dispenser drawer 220 by any suitable means, such as an outlet defined in lower surface 206 of housing 202.

Further, plate 230 defines a generally tubular channel 236 for the flow of water to a nozzle 238. As shown in the exemplary embodiment of FIGS. 9 and 10, plate 230 has a top surface 242 and a bottom surface 244, and channel 236 is defined below bottom surface 244 of plate 230 between extension portions 246. In alternative embodiments, channel 236 may be defined on top surface 242 or may be otherwise defined by plate 230.

As shown in FIG. 10, nozzle 238 having opening 239 is defined in plate 230 near the front portion 203 of housing 202 to direct a flow of water to wash basket 120. Nozzle 238 generally is formed such that the flow of fluid through channel 236 remains in the same plane until the flow reaches opening 239. Further, although nozzle 238 is shown in the exemplary embodiment as being angled with respect to the width direction W and as having opening 239 shaped as a slot, in other embodiments nozzle 238 and/or opening 239 may have other shapes and configurations. The shape or configuration of nozzle 238 and/or opening 239 may be selected based on the desired trajectory for the flow of water into wash basket 120.

Further, a given valve may control the flow of hot or cold water into channel 236 or across the remainder of plate 230. For example, in the exemplary embodiment illustrated in FIG. 10, an outlet 216 is defined at a back portion 209 of housing 202, and channel 236 is coupled to outlet 216 through the interference fit between plate 230 and housing 202. A valve 210 may provide a flow of water through inlet to housing 202 that flows from housing 202 through outlet 216 to channel 236.

Similarly, another valve 210 may provide a flow of water across the top surface of plate 230 that, as described above, flows through apertures 232 to flush a fluid additive from compartments 222. In certain embodiments, one valve 210 could be dedicated to provide water to channel 236 and one valve 210 could be dedicated to supply water to each compartment 222 of dispenser drawer 220 to flush a fluid additive from each compartment. In other embodiments, only one valve 210 may be provided to supply water to channel 236 and compartments 222. Other configurations of valves 210 could be used as well, and alternatively, water could be provided to fluid additive dispenser 200 without using valves 210.

Other configurations of channel 236, nozzle 238, and opening 239 may be used as well. As an example, channel 236 may be defined at other locations on plate 230. As a further example, channel 236 may be shaped other than generally as a tube. Additionally, nozzle 238 and/or opening 239 may have other shapes and may be positioned differently with respect to channel 236 and/or housing 202.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A washing machine appliance defining a vertical direction, the washing machine appliance comprising:
- a cabinet;
- a wash tub located within the cabinet;
- a wash basket rotatably mounted within the wash tub; and,
- a fluid additive dispenser, the fluid additive dispenser defining a sliding direction and a width direction, the fluid additive dispenser comprising
  - a housing having an upper surface, a lower surface, opposing side surfaces, a back surface, and a front portion, the housing configured to receive a flow of water;
  - a dispenser drawer slidably received in the housing, the dispenser drawer having a plurality of compartments for the receipt of one or more fluid additives; and
  - a plate disposed in the housing below the upper surface, the plate defining a channel for a flow of water, the plate further defining a nozzle within the housing,
  - wherein the nozzle directs the flow of water into the wash basket.

2. The washing machine appliance of claim 1, wherein the nozzle is formed at an end of the channel adjacent the front portion of the housing.

3. The washing machine appliance of claim 1, wherein the plate further defines a plurality of apertures for the flow-through of water to the compartments of the dispenser drawer.

4. The washing machine appliance of claim 1, further comprising a plurality of valves for controlling the flow of water into the housing.

5. The washing machine appliance of claim 4, wherein at least one valve directs a flow of water into the channel and at least one valve directs a flow of water to the remaining portions of the plate.

6. The washing machine appliance of claim 1, wherein the plate further defines a plurality of plate projections extending along the vertical direction toward the upper surface of the housing and spaced apart along the width direction, and wherein two plate projections define the channel.

7. The washing machine appliance of claim 6, wherein the plate further defines a plurality of relief slots between adjacent plate projections.

8. The washing machine appliance of claim 1, wherein the plate is press-fit into the housing.

9. The washing machine appliance of claim 1, wherein the nozzle extends downward along the vertical direction.

10. The washing machine appliance of claim 1, wherein the nozzle defines a flow path for the flow of water that is at an angle with respect to the vertical direction.

11. A washing machine appliance defining a vertical direction, the washing machine appliance comprising:

a cabinet;

a wash tub located within the cabinet;

a wash basket rotatably mounted within the wash tub; and a fluid additive dispenser, the fluid additive dispenser defining a sliding direction and a width direction, the fluid additive dispenser comprising a housing having an upper surface, a lower surface, opposing side surfaces, a back surface, and a front portion, the housing configured to receive a flow of water;

a dispenser drawer slidably received in the housing, the dispenser drawer having a plurality of compartments for the receipt of one or more fluid additives; and a plate disposed in the housing below the upper surface, the plate defining a channel for a flow of water, the channel defining a nozzle within the housing, wherein the nozzle directs the flow of water from the channel to the wash basket.

12. The washing machine appliance of claim 11, wherein the plate has a top surface and a bottom surface, and wherein the channel is defined on the bottom surface of the plate.

13. The washing machine appliance of claim 11, wherein the channel is tubular.

14. The washing machine appliance of claim 11, wherein the plate further defines a plurality of apertures for the flow-through of water to the compartments of the dispenser drawer.

15. The washing machine appliance of claim 11, further comprising a plurality of valves for controlling the flow of water into the housing.

16. The washing machine appliance of claim 11, further comprising an outlet projecting from a hack portion of the housing, the outlet configured for the flow-through of water from the housing, and wherein the channel is coupled with the outlet for the flow-through of water from the outlet and into the channel.

17. The washing machine appliance of claim 11, wherein the nozzle extends downward along the vertical direction.

18. A fluid additive dispenser for an appliance, comprising:

a housing having an upper surface, a lower surface, opposing side surfaces, a back surface, and a front portion, the housing configured to receive a flow of fluid;

a dispenser drawer slidably received in the housing, the dispenser drawer having a plurality of compartments for the receipt of one or more fluid additives; and a plate disposed in the housing below the upper surface, the plate having a top surface and a bottom surface, the bottom surface of the plate defining a channel for a flow of fluid, the channel defining a nozzle within the housing, wherein the nozzle directs the flow of fluid from the channel.

19. The fluid additive dispenser of claim 18, wherein the plate further defines a plurality of apertures for the flow-through of fluid to the compartments of the dispenser drawer.

20. The fluid additive dispenser of claim 18, wherein the channel is tubular.

* * * * *